US005625171A

United States Patent [19]

Marshall

[11] Patent Number: 5,625,171

[45] Date of Patent: Apr. 29, 1997

[54] INTERCHANGEABLE EARPIECE FOR STEREO LISTENING

[76] Inventor: Christina M. Marshall, 840 N. 1130 West, Provo, Utah 84604

[21] Appl. No.: 437,554

[22] Filed: May 9, 1995

[51] Int. Cl.[6] ..... H04R 25/02; H04R 25/00

[52] U.S. Cl. ..... 181/130; 381/187

[58] Field of Search ..... 181/129, 137, 181/130, 135; 381/187

[56] References Cited

U.S. PATENT DOCUMENTS

| | | | |
|---|---|---|---|
| 2,474,135 | 6/1949 | White | 381/187 |
| 2,641,327 | 6/1953 | Balmer | 181/129 |
| 5,412,736 | 5/1995 | Keliiliki | 381/187 |

*Primary Examiner*—Khanh Dang
*Attorney, Agent, or Firm*—Craig S. Barrus

[57] ABSTRACT

This disclosure describes an interchangeable earpiece for stereo listening. The earpiece rests comfortably behind the ear. Regardless of the activity which the person undertakes, whether it is aerobic exercising, weight lifting, or any other sport, the earpiece remains securely in place. The earpiece supports a speaker, and the conductor to the speaker is set into a groove in the earpiece. This allows the earpiece to be removed from the speaker to change sizes, colors or to simply clean the earpiece. The earpiece with the groove can be simply made by a single molding, and no further work is required other than simply laying the conductor in the groove of the earpiece and attaching the speaker.

4 Claims, 2 Drawing Sheets

INTERCHANGEABLE EARPIECE FOR STEREO LISTENING

I. BACKGROUND

Persons throughout the world have greatly enhanced their ability to enjoy music and other programming through the advent of personal and portable listening devices. These devices are typically cassette tape players, AM/FM radios, and CD players. These devices are very portable. They are easily clipped to a belt or held in the hand while the person is jogging, walking, weightlifting or any other number of activities. High quality earphones enable a person to enjoy stereophonic sound without disturbing other persons in the immediate vicinity.

One of the major drawbacks to stereo headphones is that they are often cumbersome. If the activity is vigorous, the headphones keep slipping off, which is a great annoyance to the user. There is a safety hazard if the headphones become entangled in the exercise equipment in use at the time. One of the most recent developments which greatly reduces or eliminates the problem of headphones slipping off is the earpiece which fits behind the ear of the user. There is an earpiece for each ear. The earpiece fits snugly behind the ear and supports the speaker directly over the ear. It is very difficult for the user to dislodge the earpiece regardless of the level of activity of the user.

A major drawback of the present earpieces is that the production of these devices is expensive. Complicated molds must be manufactured, and each earpiece is cast in halves. Once manufactured, the conductor must be carefully placed in the center of the earpiece halves. The halves are then carefully brought together and glued while trying to keep the conductor in the center. This is a time-consuming operation and a fair level of skill is required of the persons doing the assembly.

Another major drawback of the present earpieces is that they are difficult to clean. After a while, dirt and sweat build up on the surface of the earpiece. Because the speaker is an integral part of the earpiece, great care must be exercised with a liquid cleaner in order to prevent the speaker from getting wet.

The third drawback of the present earpieces is that if a person wishes to change colors of the earpieces to match a particular outfit, it is necessary to purchase separate earpieces and speakers for each color desired.

The present invention overcomes these three drawbacks by using a groove in the exterior of the earpiece to carry the conductor. This allows a greatly simplified mold to be lo used for the injection molding process. Assembly of the speaker to the earpiece consists of inserting the peg into the socket on the earpiece. It is then a simple matter of pressing the conductor in the groove. No messy, dangerous solvents are used. The skill level is greatly reduced to simply laying the conductor inside the groove.

The second drawback of cleaning is also resolved. It is a simple matter to pull the conductor from the groove and remove the speaker from the earpiece. The whole unit can then be cleaned and disinfected by total immersion if desired. When the earpiece is dry, the speaker is placed on the earpiece and the conductor placed back in the groove. Again, no special skills or materials are required to clean the earpiece as often as desired.

The third drawback of interchangeablity is also resolved. Several earpieces of different colors may be purchased for a nominal cost without the need to purchase a speaker for each earpiece. To change colors, it is a simple matter to remove the earpiece from the speaker and replace it with the earpiece of the desired color. Different sizes may also be interchanged to allow children and adults to use different sizes of earpieces without the need of purchasing separate speakers.

For the above reasons, there is a need for an earpiece which is easily manufactured and assembled, with the additional advantages of being easily cleaned and interchangeable with other earpieces of different colors or sizes.

II. SUMMARY

The present invention is directed to an interchangeable earpiece for stereo listening while using a portable AM/FM radio, cassette player, or CD player. The earpiece is curved to conform to a person's ear and to secure the speaker to the ear. The earpiece is placed behind the ear, with the speaker directly over and contacting the ear canal. The earpiece has a longitudinal groove in the exterior of the earpiece to allow a conductor to be pressed into the groove. There is a socket on the end of the speaker to receive the peg of the earpiece to secure the speaker to the earpiece.

III. BRIEF DESCRIPTION OF THE DRAWINGS

These and other features, aspects and advantages of the present invention will become better understood with regard to the following description, appended claims, and accompanying drawings where:

IV. DESCRIPTION

Figure 1:
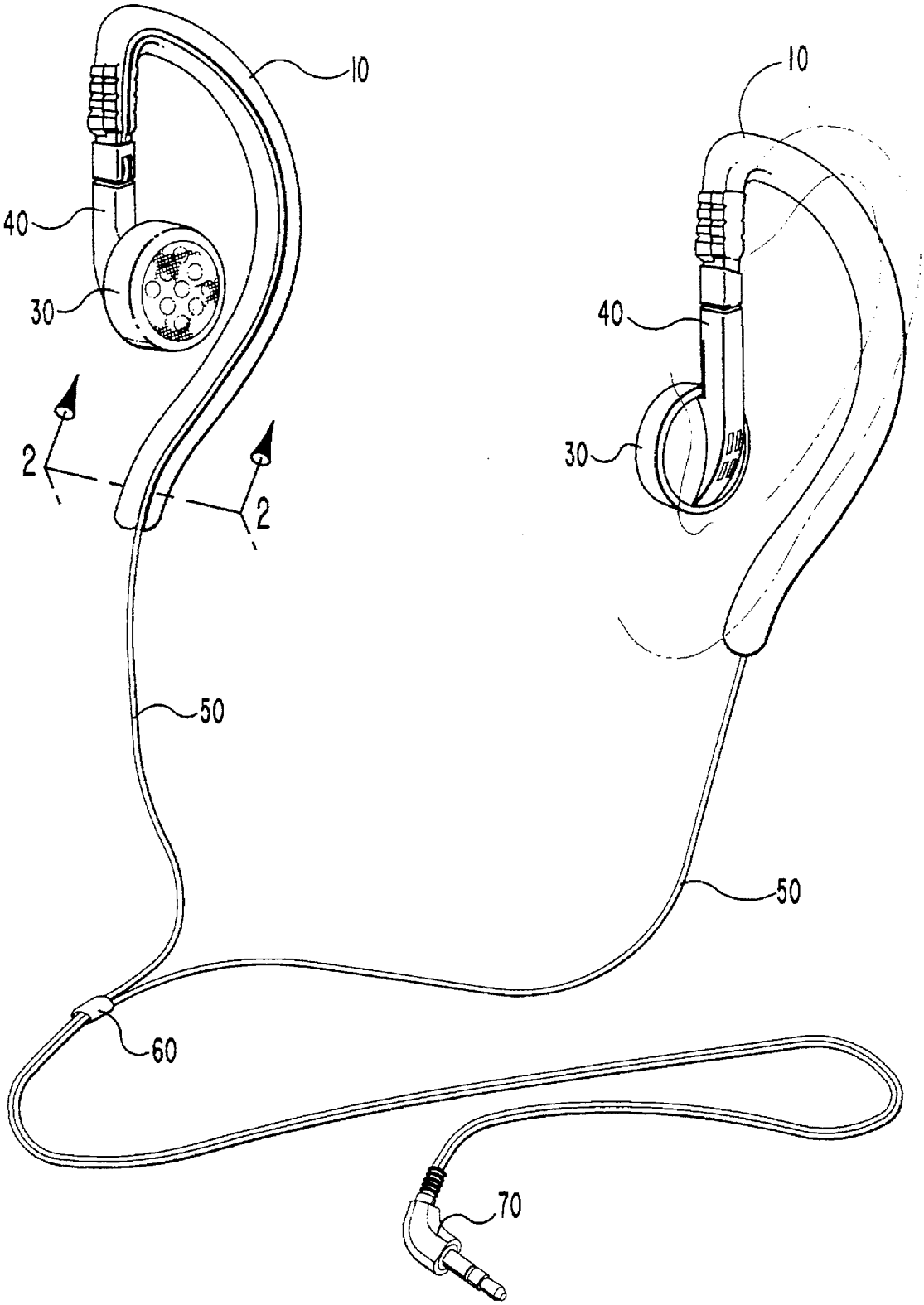
FIG. 1 shows a perspective view of the interchangeable earpiece.

FIG. 1 is a perspective view of the interchangeable earpiece (10). The earpiece (10) is connected to the speaker (30). The conductor (50) provides an electrical path between the plug (70) and the speaker (30), and where the conductor (50) seperates, a stay (60) is placed to keep the conductor (50) from further seperating. The conductor (50) is pressed into a groove in the earpiece (10). The speaker (30) has a socket (40) for attaching the speaker (30) to the earpiece (10). Each earpiece (10) is a mirror image of the other so that the earpiece (10) will fit the left ear and the right ear of the user.

Figure 2:
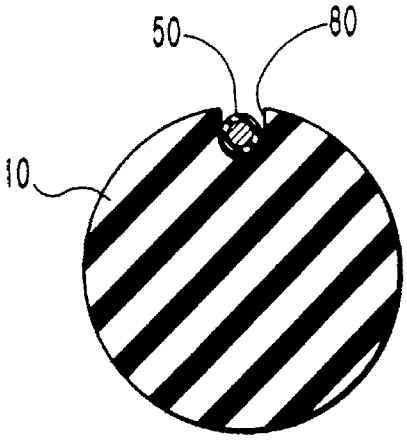
FIG. 2 shows a sectional view of the earpiece.

FIG. 2 is a sectional view of the earpiece (10). The earpiece (10) has a groove for receiving the conductor (50). The groove is located in the surface of the earpiece (10). The best location of the groove in the earpiece (10) is between the earpiece (10) and the head of the user, though the groove could be placed anywhere along the earpiece (10) itself.

Figure 3:
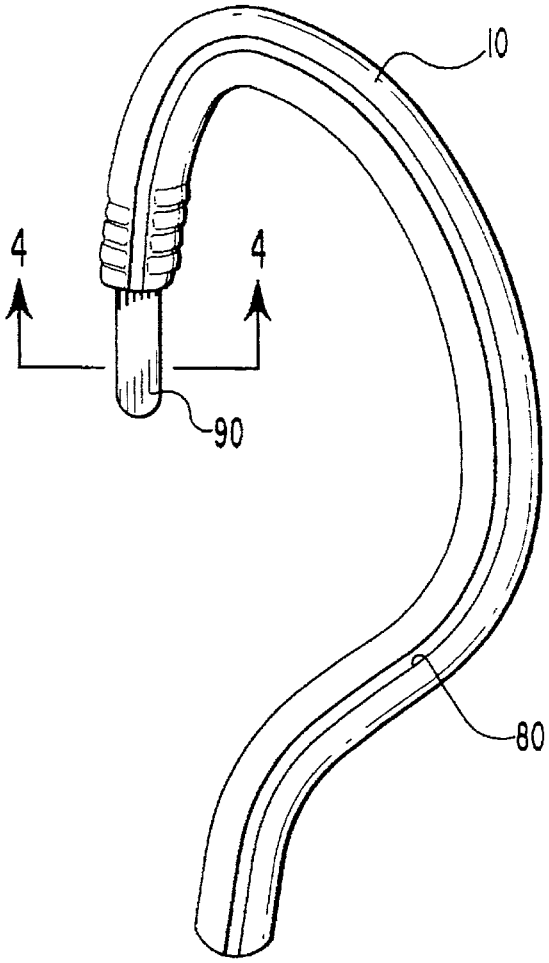
FIG. 3 is a perspective view of the earpiece only.

FIG. 3 is a perspective view of the earpiece (10). There is a peg (90) located on the end of the earpiece (10) to receive the speaker (30). The groove (80) is shown in the surface of the earpiece (10) running the length of the earpiece (10).

Figure 4:
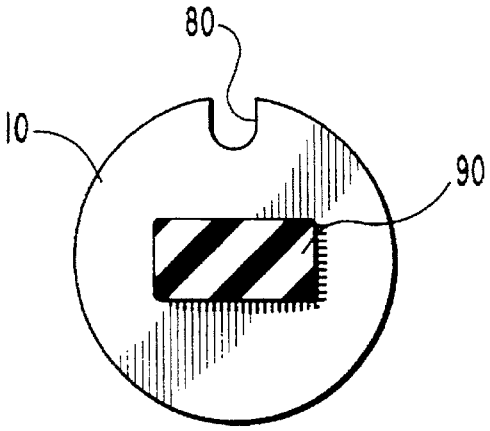
FIG. 4 is a sectional view of the earpiece only.

FIG. 4 is a sectional view of the earpiece (10) showing a configuration of the groove (80) and the peg (90). Though the peg (90) could be practically any shape, the best cross-sectional shape found so far is that of a rectangle.

The present invention, of course, may be carried out in other specific ways other than those set forth above without departing from the scope of the invention. The above embodiments are, therefore, to be considered as illustrative, and the applicant intends only to be limited by the claims appended hereto.

What is claimed is:

1. An interchangeable earpiece for stereo listening, comprising:

a speaker;

an earpiece having an external surface connected to the speaker, wherein the earpiece is to be placed behind each ear to support the speaker;

a conductor which is electrically connected to the speaker;

and a plug which is electrically connected to the conductor, wherein the earpiece has a groove in the external surface of the earpiece to removably receive the conductor.

2. An interchangeable earpiece for stereo listening as in claim 1, wherein the earpiece has a peg for removably attaching the speaker to the earpiece, and the speaker has a socket to receive the peg of the earpiece.

3. An interchangeable earpiece for stereo listening as in claim 2, wherein the conductor has a stay to prevent the conductor from separating.

4. An interchangeable earpiece for stereo listening as in claim 1, wherein each earpiece is a mirror image to allow usage of the earpiece for the left ear and for the right ear.

* * * * *